US005275494A

United States Patent [19]

Petracca et al.

[11] Patent Number: 5,275,494

[45] Date of Patent: Jan. 4, 1994

[54] ELECTRONIC TYPEWRITER WITH SEPARATELY ATTACHABLE DISPLAY MODULE AND ELECTRONIC CONTROL UNIT

[75] Inventors: Antonio Petracca, Volpiano; Emilio Robuschi, Romano Canavese, both of Italy

[73] Assignee: Ing. C. Olivetti & C., S.p.A., Ivrea, Italy

[21] Appl. No.: 789,866

[22] Filed: Nov. 12, 1991

[30] Foreign Application Priority Data

Dec. 10, 1990 [IT] Italy ..... 67986 A/90

[51] Int. Cl.[5] ..... B41J 3/46; B41J 29/02

[52] U.S. Cl. ..... 400/83; 400/692; 400/693; 364/708.1; 361/680; 361/681

[58] Field of Search ..... 400/83, 84, 85, 679, 400/682, 691, 692, 693; 364/708; 361/380, 395; 248/919

[56] References Cited

U.S. PATENT DOCUMENTS

| | | | |
|---|---|---|---|
| 4,530,066 | 7/1985 | Ohwaki et al. | 364/708 |
| 4,808,017 | 2/1989 | Sherman et al. | 400/83 |
| 4,931,909 | 6/1990 | Backes | 361/380 |
| 5,120,141 | 6/1992 | Kieling | 400/693 |

FOREIGN PATENT DOCUMENTS

| | | | |
|---|---|---|---|
| 3403414 | 8/1985 | Fed. Rep. of Germany | 400/692 |
| 3532584 | 3/1987 | Fed. Rep. of Germany | 400/691 |
| 295058 | 12/1986 | Japan | 400/691 |
| 21175 | 1/1988 | Japan | 400/692 |
| 197682 | 8/1988 | Japan | 364/708 |

OTHER PUBLICATIONS

Patent Abstracts of Japan, vol. 14, No. 477 (P-111) Oct. 17, 1990 & JP-A-2 193 207 (Masami) Jul. 30, 1990.

Patent Abstracts of Japan, vol. 14, No. 538 (P-113) Nov. 28, 1990 & JP-A-2 228 690 (Koji) Sep. 11, 1990.

Patent Abstracts of Japan, vol. 9, No. 316 (M-438) Dec. 12, 1985 & JP-A-60 151 075 (Shigenori) Aug. 8, 1985.

Patent Abstracts of Japan, vol. 10, No. 254 (P-492) Aug. 30, 1986 & JP-A-61 080 305 (Yoshio) Apr. 23, 1986.

Patent Abstracts of Japan, vol. 6, No. 27 (P-102) Feb. 17, 1982 & JP-A-56 145 379 (Takatoshi) Nov. 12, 1981.

Patent Abstracts of Japan, vol. 9, No. 224 (P-387) Sep. 10, 1985 & JP-A-60 082 883 (Hiroaki) May 11, 1985.

*Primary Examiner*—Edgar S. Burr
*Assistant Examiner*—Stephen R. Funk
*Attorney, Agent, or Firm*—Banner, Birch, McKie & Beckett

[57] ABSTRACT

An electronic typewriter has an electronic control circuit housed with the usual typing mechanism in a casing, and can be provided with a display module for displaying text and/or machine functions. The display module is removably fixed to the casing. An electronic unit for controlling the display module is removably fitted in the casing and is connected to the control circuit and the display module by connectors. A basic typewriter without a display module can be constructed with a cover instead of the display module. The two types of typewriter can be produced on largely the same production line, and the basic typewriter can be simply upgraded with a display module in the field.

19 Claims, 7 Drawing Sheets

ELECTRONIC TYPEWRITER WITH SEPARATELY ATTACHABLE DISPLAY MODULE AND ELECTRONIC CONTROL UNIT

BACKGROUND OF THE INVENTION

The present invention concerns an electronic typewriter comprising typing members and electromechanical devices for actuating typing and machine functions, electronic control means for associated control thereof, and a casing which encloses said members and said devices.

Electronic typewriters with a line display and electronic typewriters without any display are known for example from Italian Industrial Model Registrations Nos. 53 508 and 53 506. Both those machines are substantially similar and differ only in the upper part of the casings insofar as the first machine has a cover which carries a display while the second machine has just a plain cover. The electronic control means of the first machine is however different from that of the second machine insofar as the first control means has to control the functions of the display, as well as the series of typing members and function devices. Those differences do not permit the manufacturer to achieve economies of scale and to have a single automated production line for the two models of machine and they do not permit the user to add a display to a basic machine at a time subsequent to purchase thereof.

SUMMARY OF THE INVENTION

An object of the present invention is therefore to provide an electronic typewriter of relatively low cost and to which a display module can be fitted in a simple and economical fashion without the use of tools and instruments, so as to provide machines with greatly enhanced levels of performance in comparison with those of a basic model.

An electronic typewriter embodying the invention is provided with a display module for displaying text and/or machine functions; fixing means for removably fixing the display module to said casing; an electronic unit for controlling the display module; and connecting means for removably connecting the electronic unit to the display module.

BRIEF DESCRIPTION OF THE DRAWINGS

These and other features will be apparent from the following description relating to a preferred embodiment of the invention by way of non-limiting example, with reference to the accompanying drawings in which.

DETAILED DESCRIPTION OF THE PREFERRED EMBODIMENT

Figure 1:
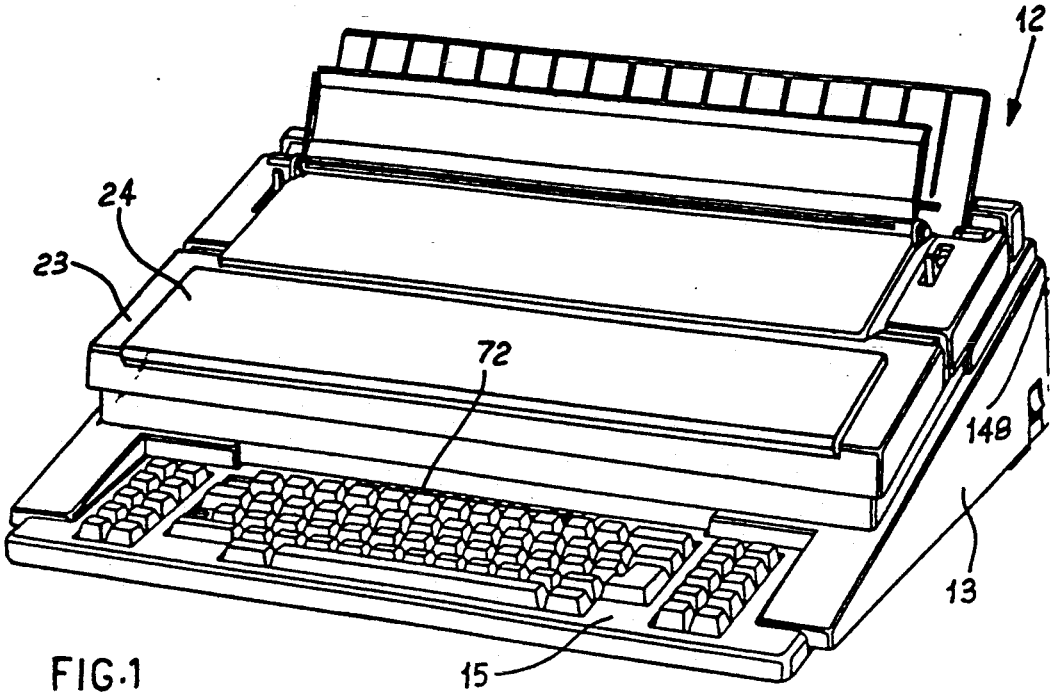
FIG. 1 is a right front perspective view of an electronic typewriter embodying the invention.

Referring to FIGS. 1, 2, 6 and 13, an electronic typewriter 12 comprises a keyboard 15, a supply circuit 20, the usual typing members and electromechanical function devices which actuate the machine functions, for example of the type used in the Olivetti daisywheel typewriter ET2200, an electronic control means 21, and a casing 13 which encloses such members and devices, the circuit 20 and the control means 21. The typing members comprise for example a character selection device 14 and a ribbon feed mechanism 16, and the function devices comprise a line spacing device 17, a carriage transport device 18 and a striker electromagnet for printing characters, as indicated at 19. Those devices 14, 15, 16, 17, 18, 19 and 20 not being part of the present invention, they are only shown in diagrammatic form and are not described in detail.

Figure 2:
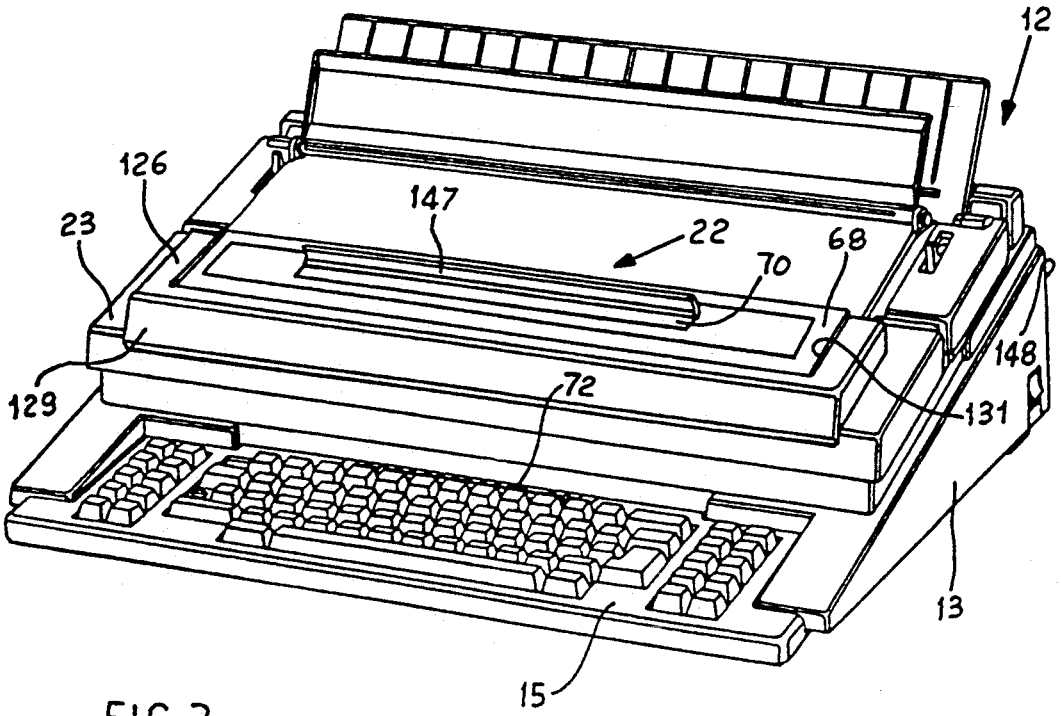
FIG. 2 is a right front perspective view of an electronic typewriter embodying the invention.
Figure 3:
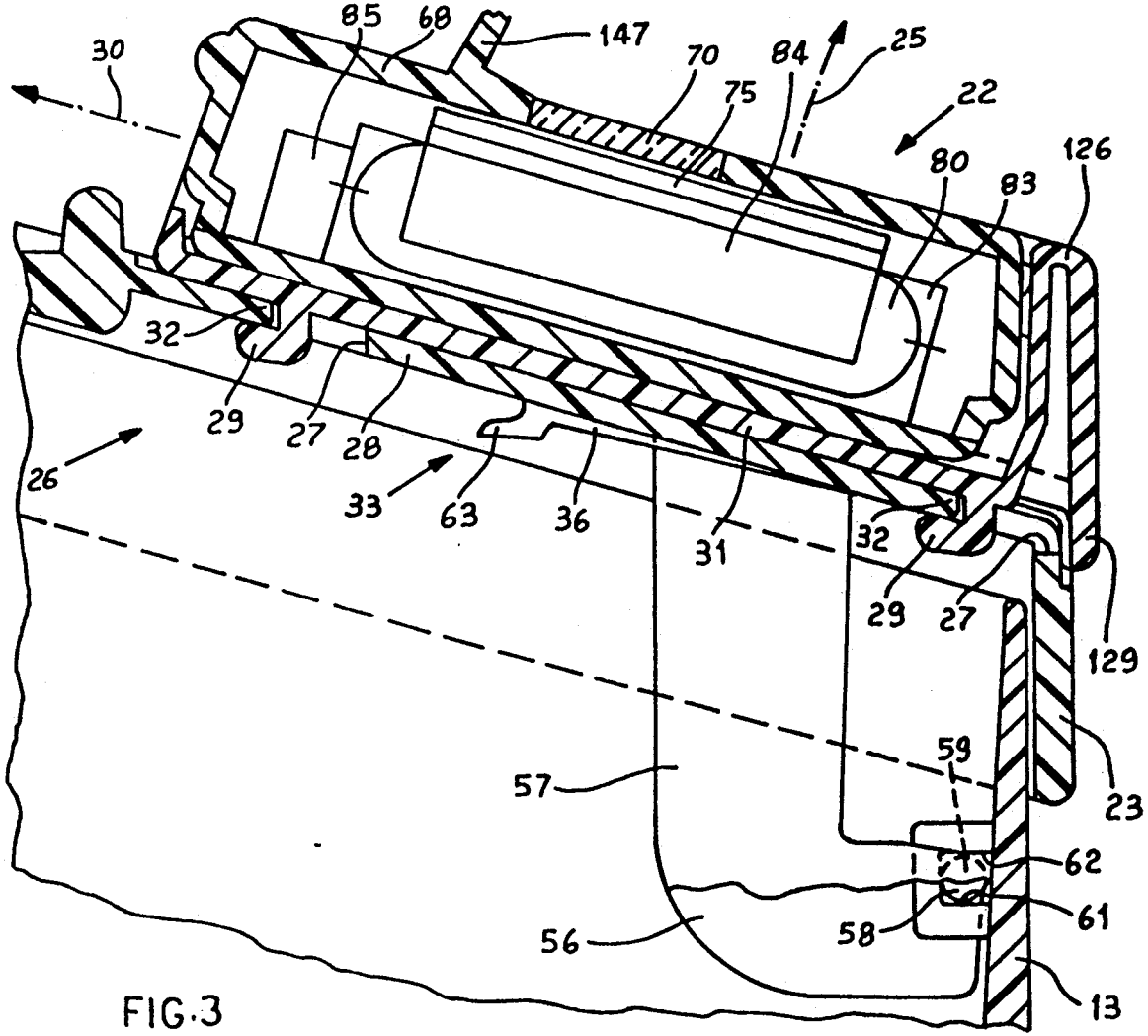
FIG. 3 is a partial side view in section of some details from FIG. 2 on a different scale.

A display module 22 for displaying text and/or functions of the machine 12 can be removably fixed on a cover 23 of the casing 13 as an alternative to a cover member 24, as can be clearly seen from FIGS. 1 and 2.

Fixing means (FIGS. 3, 4, 5, 6, 9, 10 and 13) which are generally indicated at 26 removably fix the display module 22 or alternatively the cover member 24 to the cover 23 and operate in a first direction 25 perpendicular to the cover 23 and in a second direction 30 perpendicular to the first direction along the cover 23. The fixing means 26 comprise a series of openings 27 on an element of a pair comprising the display module 22 and the casing 13 and a series of hooks 29 on the other element of the pair. In the non-limiting example, the series of openings 27 are provided in a flat surface 28 of the cover 23 and the series of hooks 29 projecting from a bottom 31 of the display module 22 and the cover member 24 and being capable of being accommodated in the series of openings 27 to engage with edges 32 of the openings 27, thus preventing movement of the display module 22 or the cover member 24 with respect to the cover 23 in the first direction 25. The fixing means 26 comprise resiliently-deformable counteracting members which are generally indicated at 33 and which can be coupled to counteracting surfaces generally indicated at 34 for fixing the display module 22 or the cover member 24 on the cover 23 of the casing 13 by latching engagement.

The resiliently-deformable counteracting members 33 are capable of coming into latching engagement with the counteracting surfaces 34 after engagement of the hooks 29 with the edges 32 to prevent movement of the display module 22 or the cover member 24 with respect to the cover 23 in the second direction 30. There are two counteracting members 33 and they each comprise a resilient tongue 36, 37 (FIGS. 4 and 5) provided by the flat surface 28 of the cover 23 and elongate parallel to the direction 30 and having a counteracting end 38, 39, and two seats 41 and 42, 43 and 44 such as to delineate a deformable edge 46, 47. The resilient tongues 36, 37, with the end 38, 39 and the seats 41 and 42, and 43 and 44 respectively, are coaxial with each other.

There are two counteracting surfaces 34 and they each comprise a shoulder 48, 49 (FIGS. 4 and 10) and a pin portion 51, 52 which project from the bottom 31 of the display module 22 and the cover member 24. Each shoulder 48, 49 is coaxial with the corresponding pin portion 51, 52 and is reinforced and stiffened at the ends by limbs 53, 54 (FIG. 9) which are perpendicular to the shoulder 48, 49. Each pin portion 51, 52 is capable of being accommodated in the seat 41, 42 while each resilient tongue 36, 37 urges the counteracting end 38, 39 against the respective shoulder 48, 49 in such a way as to hold the respective pin portion 51, 52 against the deformable edge 46, 47 for fixing the display module 22 or the cover member 24 on the cover 23 of the casing 13 without play.

The cover 23 is movable from a first position in which it is normally supported on the casing 13 to a second position in which it is rotated through about 90°. The second position permits access to the interior of the casing 13 in order to have access to the printing members and the electromechanical devices 14, 16, 17, 18 and 19 and for mounting either the display module 22 or the cover member 24 as described hereinafter. The cover 23 is movable by means of two arms 56 and 57 (FIGS. 3 and 4) projecting from the flat surface 28 inwardly of the casing 13 and each being provided at the free end with a pin portion 58, 59 rotatably accommodated in a seat 61, 62 in the casing 13.

When either the display module 22 or the cover member 24 is mounted on the cover 23, the resilient tongues 36 and 37 urge the ends 38 and 39 against the respective shoulders 48 and 49 and have an irreversible action, after latching engagement, on the display module 22 or the cover member 24. Each resilient tongue 36, 37 comprises a projection 63, 64 which projects from the plane of the tongue and which is capable of being actuated manually to disengage the end 38, 39 from the respective shoulder 48, 49 when the cover 23 is positioned in the second position.

The supply circuit 20 (FIG. 13) is of known type and provides on two lines 45 and 50 low voltage direct currents at 5 V and 24 V respectively for the logic circuits and for actuation of the electronic control means 21.

The display module 22 comprises a case 68 of elongate parallelepipedic shape and formed for example by two shell portions, being provided on its top with a window 70 and accommodating a flat elongate display 75 of the liquid crystal type which can be observed in a transparency mode, and a neon lamp 80 of tubular shape which is disposed beside the display 75. The casing 68 also accommodates a shield 83 for the lamp 80, a diffuser lens 84 whose edge is illuminated by the lamp 80, and a voltage booster circuit 85 of the inverter type which is supplied with the 24 V current from the circuit 20 and which is capable of supplying alternating current at high voltage (400 V) to the lamp 80, and a regulating circuit 86 which operates on the circuit 85 to modify the illumination and thus the contrast of the display 75.

The electronic control means 21 (FIGS. 1, 2, 6, 7, 8 and 13) comprises a printed circuit board 60 supported by a base support 66 of the machine 12 and a series of components mounted on the printed circuit 60 and comprising a microprocessor CPU 67, which is connected to the keyboard 15, ROM memory 69, RAM memory 71, an actuator 73 for actuating the selection device 14 and the ribbon feed mechanism 16, an actuator 74 for the line spacing and transport devices 17 and 18 and an actuator 76 for the striker electromagnet 19. The CPU 67 also controls an illuminated indicator 72 for immediate display on the machine 12 of the operative conditions selected by the operator.

An electronic unit 77 for controlling and operating the display 75 can be mounted removably within the casing 13 and can be functionally connected removably to the electronic control means 21. The electronic unit 77 (FIGS. 6 to 8, and 13) is supported by a metal plate member 78 and comprises a printed circuit board 87 on which are disposed a microprocessor CPU 79, ROM memory 81 and RAM memory 82 for controlling and actuating functions of the display 75. Electrical connecting means indicated at 88 removably connect the electronic unit 77 to the display module 22. The electrical connecting means 88 comprise a flexible cable 89 and a connector 91 capable of being connected to a complementary connector 92 of the electronic control unit 77.

The cover 23 (FIGS. 4, 6 and 10) suitably comprises an opening 93 for permitting the connector 91 of the display module 22 to pass therethrough, a groove 94 connected to the opening 93 to guide the flexible cable 89 and a limb 96 which projects in the interior of the cover 23 and is adjacent to the groove 94 to guide the flexible cable 89 between the limb 96 and the inward edge of the cover 23. Finally the electronic unit 77 can be functionally connected removably to the electronic unit 21 by means of a connector 97 on the unit 77 and a complementary connector 98 on the electronic control means 21.

The plate member 78 (FIGS. 6, 7 and 8) on which the electronic unit 77 is supported comprises a plate portion 101 which is perpendicular thereto, and has a limb 102 projecting from an upper edge 103 and capable of engaging a suitably shaped seat 104 of the base support 66 of the machine 12. Also fixed on the plate member 78 is a resilient pin portion 106 having a mushroom-shaped, resiliently yielding end 107 capable of passing through a hole 108 in the base support 66. The plate member 78 can be removably fixed to the base support 66 by means of the resilient end 107 and a flange 109 which are positioned between the upper and lower edges of the base support 66. Two seats 111 and 112 in the base support 66 permit the connectors 91, 92 and 97, 98 to be passed therethrough and positioned therein when the plate member 78 is removably fixed to the base support 66 as described hereinafter.

The casing 13 has a bottom 113 (FIGS. 6 and 7) with an access opening 114 to permit access to and fixing of the plate member 78 to the base support 66. The opening 114 has an edge 116 at one side and a seat 117 at the other side, and can be closed by a cover portion 118 which can be removably fixed to the bottom 113. The cover portion 118 suitably has a forked edge 119 at one side and a resilient catch 121 at the other side, wherein the forked edge 119 is capable of engaging the edge 116 of the opening 114 and the resilient catch 121 is capable of engaging into the seat 117 in order thus removably to fix the cover portion 118 to the bottom 113.

Figure 11:
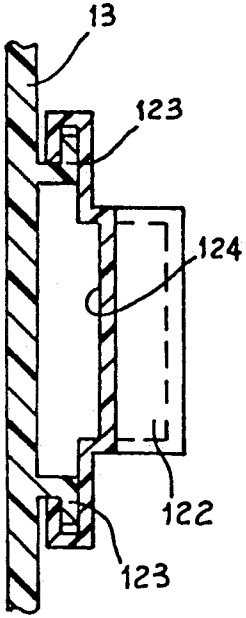
FIG. 11 is a partial plan view in section of some details from FIG. 6 on a different scale.
Figure 4:
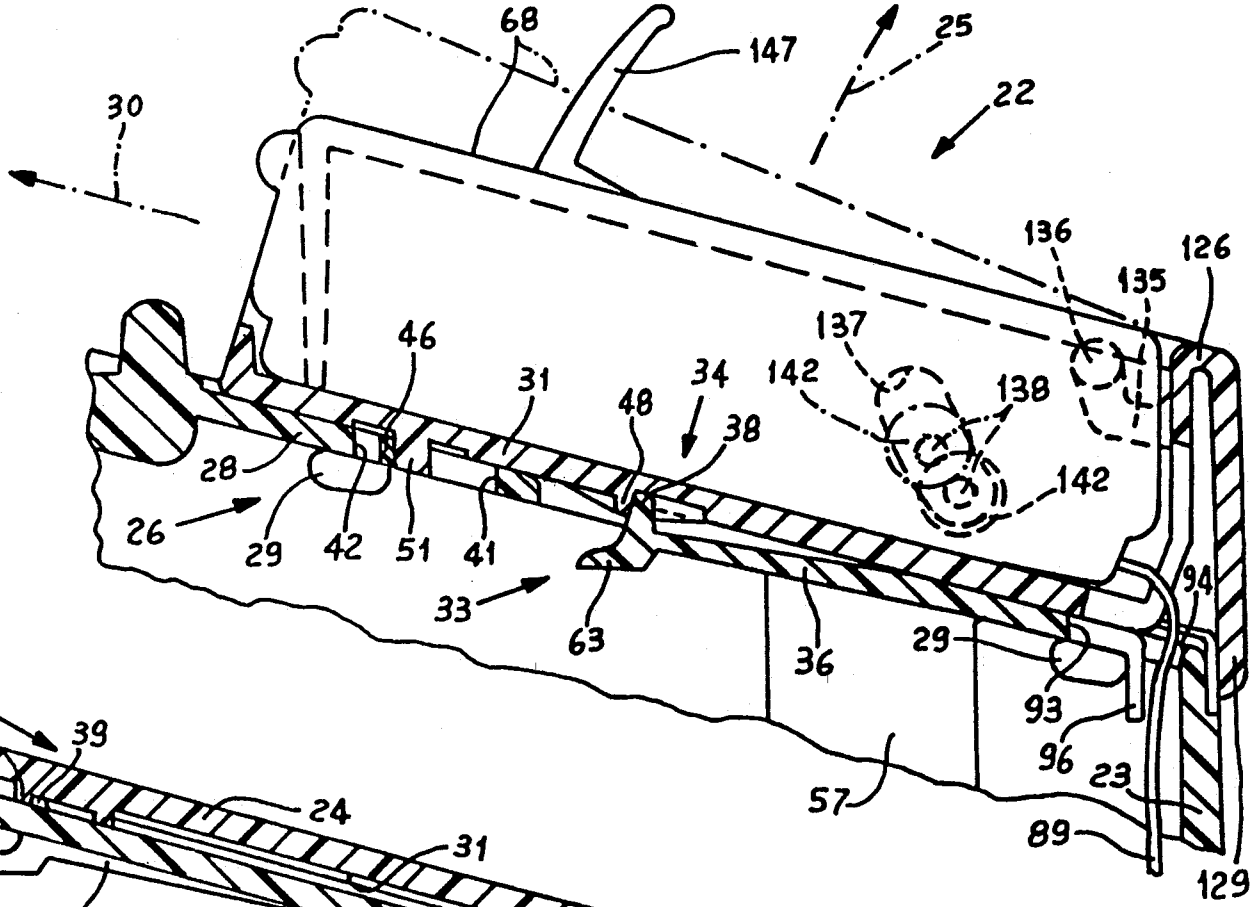
FIG. 4 is a partial side view in section of other details from FIG. 2 on a different scale.
Figure 5:
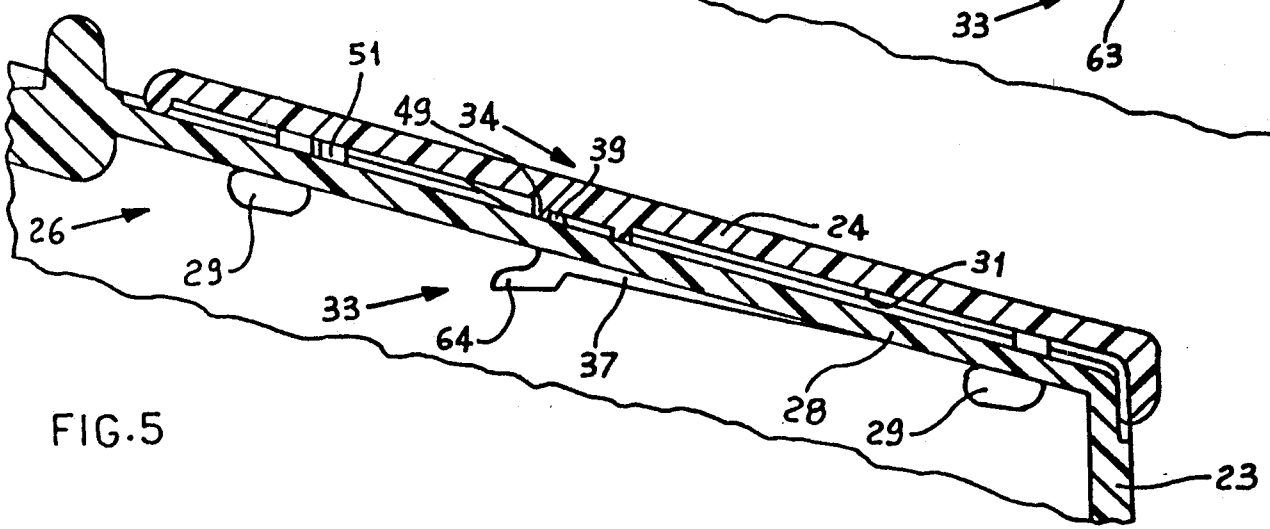
FIG. 5 is a partial side view in section of some details from FIG. 1 on a different scale.
Figure 6:
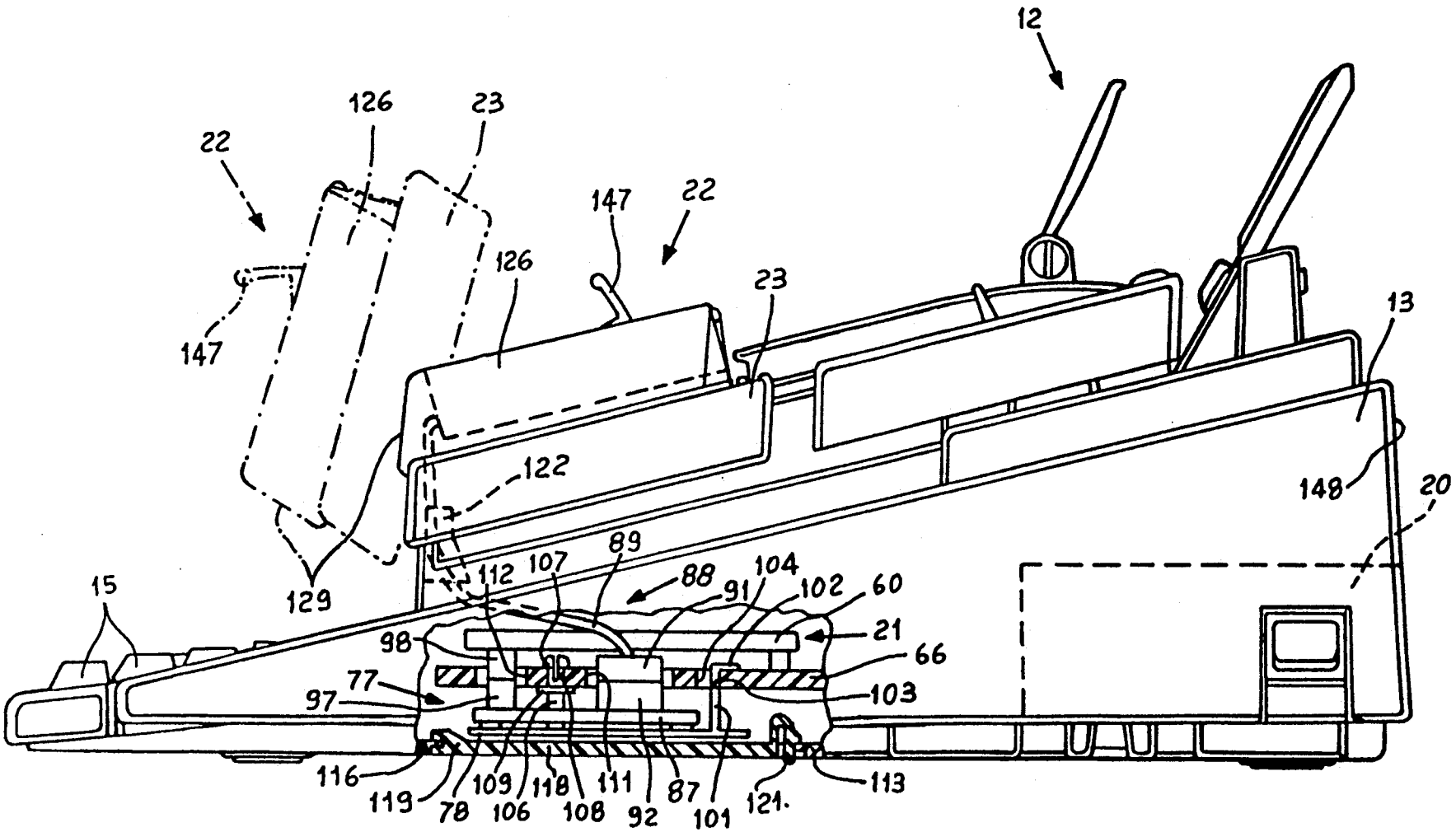
FIG. 6 is a partly sectional side view of the FIG. 2 machine.
Figure 12:
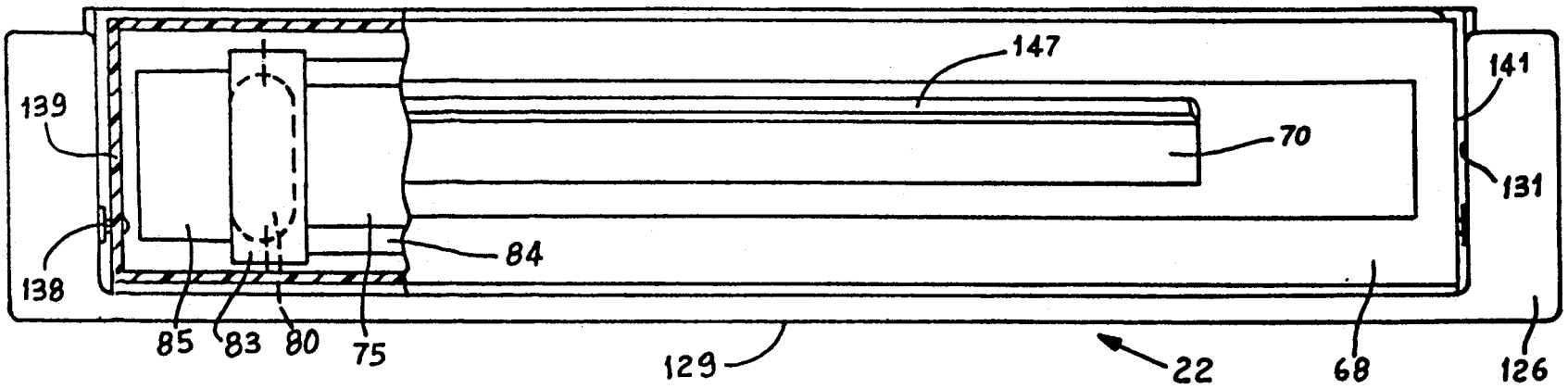
FIG. 12 is a partial plan view of some details from FIG. 3 on a different scale.
Figure 8:
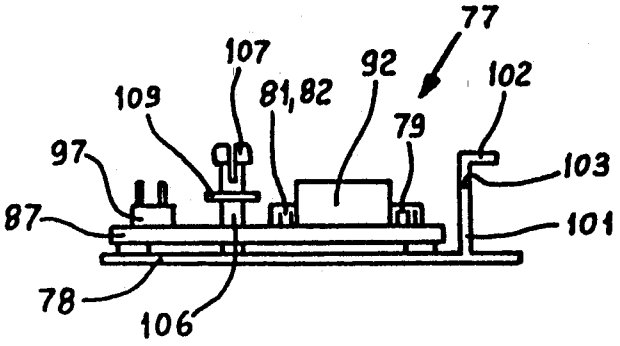
FIG. 8 is a side view of some details from FIG. 7.
Figure 7:
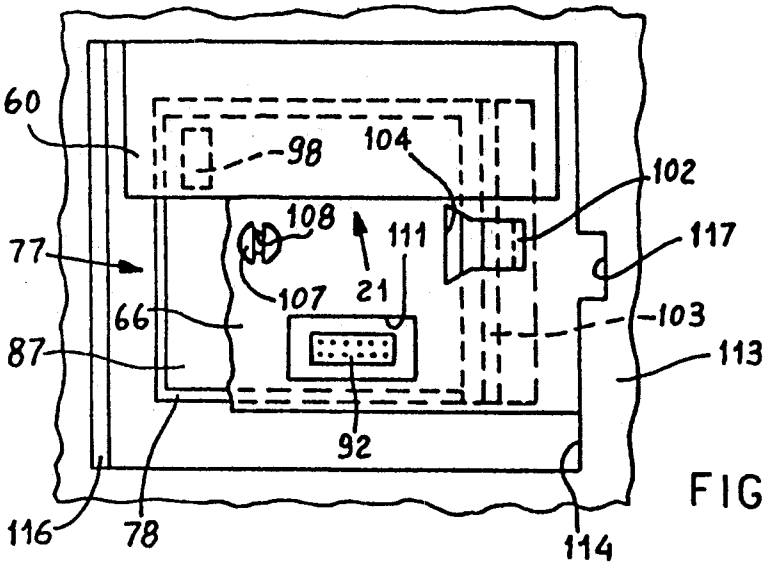
FIG. 7 is a plan view of some details from FIG. 6 on a different scale.
Figure 9:
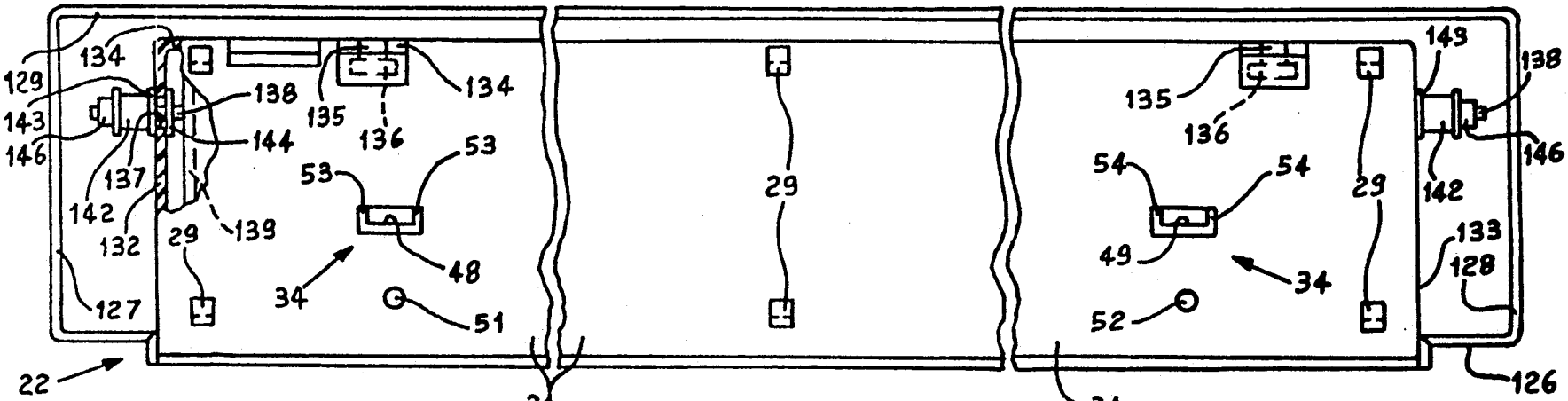
FIG. 9 is a partial plan view of some details from FIG. 3 on a different scale.
Figure 10:
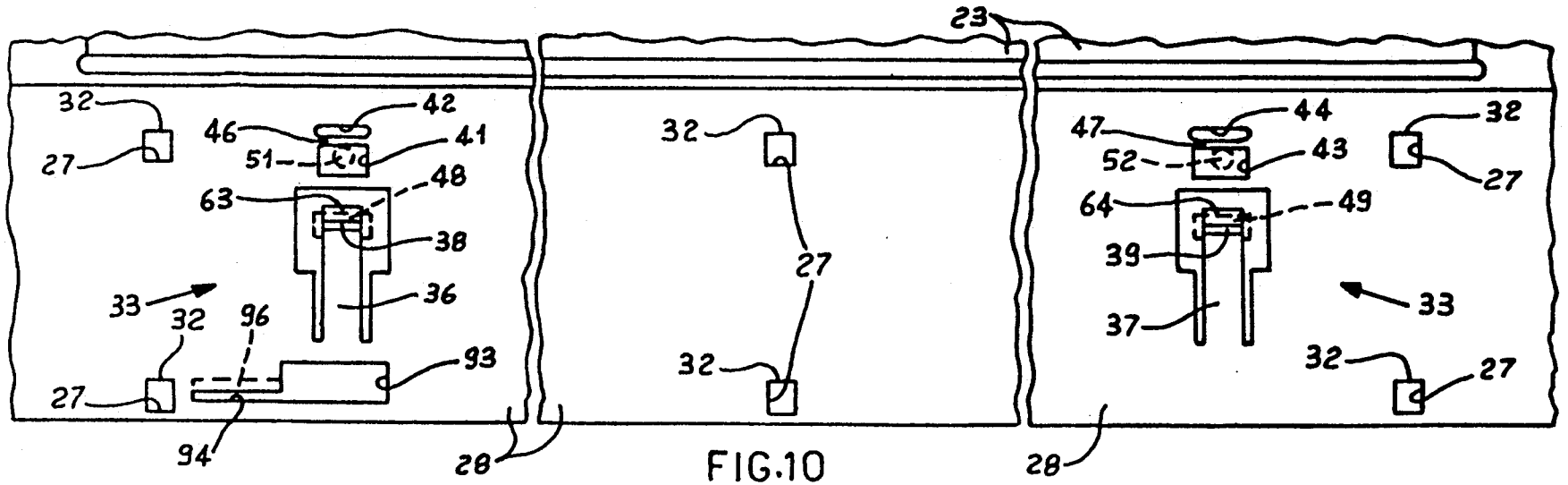
FIG. 10 is a partial plan view of other details from FIG. 3 on a different scale.
Figure 13:
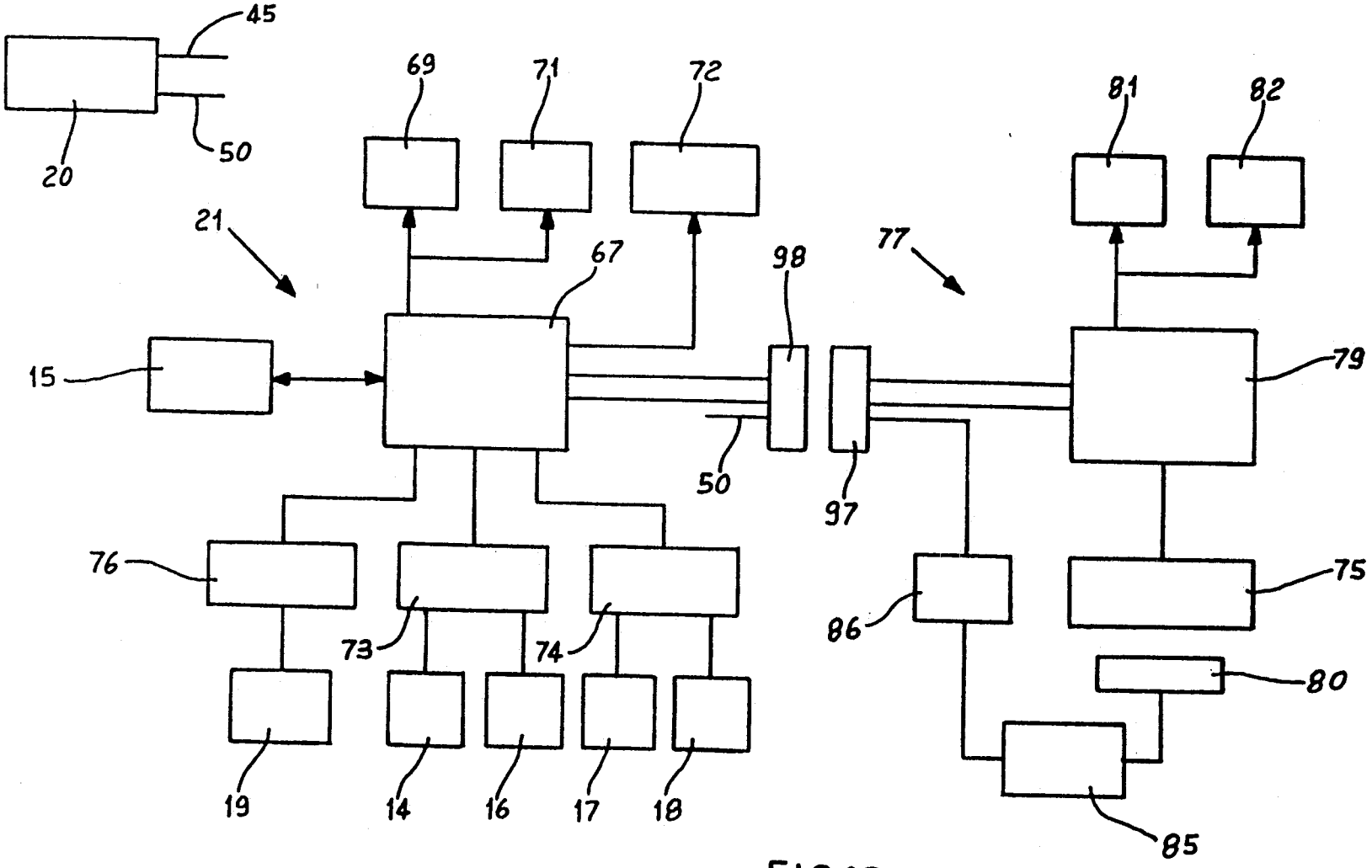
FIG. 13 shows a logic block circuit diagram of the operating and control unit of the machine of FIG. 2.

A protection element 122 (see FIGS. 6 and 11) is positioned within the casing 13, is slidable on two fixed guides 123 of the casing 13 and defines a seat 124 for accommodating the flexible cable 89 of the display module 22 in such a way as to prevent contact from occurring between the typing members and the flexible cable 89 during the movements of the carriage in the printing phase.

The display module 22 (see FIGS. 2, 3, 4, 9 and 12) comprises a base body 126 of substantially parallelepipedic elongate shape which is delimited in its lower part by the bottom 31, by two side portions 127 and 128 and by a front wall 129 and which in its upper part has a parallelepipedic, rearwardly open opening 131 and in which the case 68 is accommodated. The opening 131 is delimited laterally by two side portions 132 and 133 parallel to the side portions 127 and 128 and by a front wall 134 which is parallel to the wall 129 and projecting into same are two pin portions 136 supported by two respective arms 135 which are fixed to the wall 134. The case 68 is pivoted in its upper part on the pin portions 136 in such a way as to be capable of modifying the angle of inclination of the display 75 after the base body 126 is mounted on the machine 12. Provided in the side portions 132 and 133 are two respective slots 137 which are engaged by two pin portions 138 which are each fixed to a corresponding side portion 139, 141 of the case 68 to define the angle of inclination of the display 75. The movement of the case 68 is also braked by means of two small cylinders 142 of elastomer which are supported by the pin portions 138 and which urge two friction washers 143 against the side portions 132 and 133, being counteracted by a pair of flanges 144 and screwthreaded stops 146.

Finally a plate portion 147 projects upwardly from the case 68 and is positioned adjacent to the window 70 overhanging the display 75 to protect it from any light reflection.

The electronic typewriter 12 in FIG. 1 is a basic machine having a series of performance parameters which are substantially limited to those of typing and correction. According to operator requirements the machine can increase its performance parameters by subsequently fitting additional parts, for example the display module 22 and the plate member 78 as described hereinbefore in order to provide the electronic typewriter 12 shown in FIG. 2. In addition the display module 22 can be selected from modules having different characteristics, in particular in regard to the number of lines of text and/or the number of characters. A first version provides for example two lines of 40 characters while a second version provides two lines of 80 characters.

The electronic unit 77 may also be selected from different versions with different memory capacities and different performances, both for correct management of the selected module 22 and for satisfying the user requirements in the optimum fashion.

Fitment of the display module 22 and the plate member 78 to the typewriter 12 in FIG. 1 is as follows.

With reference to the above-described Figures, the operator turns the machine in such a way as to have the bottom 113 facing the operator with the machine being supported on the rear part 148 of the casing 13. Using one hand, the operator flexes the resilient catch 121 to disengage it from its seat 117, and removes the cover portion 118. The operator takes the plate member 78, positions it in the access opening 114 while holding it inclined at about 45° with respect to the base support 66 and engages the limb 102 in the seat 104. The operator then turns the plate member 78 so as to position it parallel to the base support 68, in which the resilient pin portion 106 is positioned and is engaged in the hole 108. The plate member 78 is thus removably fixed to the base support 66 and is held in position by the action of the upper edge 103 of the plate portion 101 which bears against the lower edge of the base support 66, by means of the limb 102 which bears against the upper edge of the base support 66, by way of the resilient end 107 which bears against the upper edge of the base support 66 and by way of the flange 109 which bears against the lower edge of the base support 66. During that turning movement the connector 97 of the electronic unit 77 is engaged with the connector 98 of the first electronic control means 21 while the connector 92 is positioned in the seat 111 of the base support 66. The operator refits the cover portion 118, positioning the forked edge 119 over the edge 116, and presses against the cover portion 118 until the resilient catch 121 is re-engaged with the seat 117 and thus positions the machine in its operating position.

To remove the cover member 24, the operator rotates the cover 23 to position it in its second position (as shown in dash-dotted lines in FIG. 6) and then flexes the resilient tongues 36 and 37 by acting on the projections 63 and 64 thereof until the ends 38 and 39 are disengaged from the respective shoulders 48 and 49. The operator displaces the cover member 24 parallel to the flat surface 28 in the opposite direction to the second direction 30 to disengage the hooks 29 from the edges 32 of the openings 27 and thus moves the cover member 24 in the first direction 25, away from the cover 23.

The operator now removes the protection element 122 by sliding it along the fixed guides 123 and then takes the display module 22 and moves it towards the cover 23, passes the connector 91 into the opening 93 and positions the flexible cable 89 in the groove 94. The operator positions the cover 23 in its first position and then brings the hooks 29 on the base body 126 into positions corresponding to the respective openings 27 and positions them by accommodating them in the openings 27 against the force of the resilient tongues 36 and 37. The operator displaces the display module 22 parallel to the flat surface 28 to engage the hooks 29 with the edges 32 of the openings 27 while the pin portions 51 and 52 move in their seats 41 and 43, moving towards the deformable edges 46 and 47. As the hooks 29 are engaged with the edges 32, the resilient tongues 36 and 37 cause the respective counteracting ends 38 and 39 to come into latching engagement with the corresponding shoulders 48 and 49, holding the pin portions 51 and 52 against the resiliently deformable edges 46 and 47. In that way the display module 22 is fixed without play to the flat surface 28 of the cover 23.

The operator now positions the cover 23 in its second position, engages the connector 91 with the connector 92 of the electronic unit 77 and then refits the protection element 122 on the fixed guides 123 whereby the flexible cable 89 is still guided by the seat 124. The operator returns the cover 23 to the first position and the electronic typewriter 12 is ready for use. The module 22 cannot be removed by movement in the directions 25 and 30. In order possibly to remove the display module 22 and the electronic unit 77, the procedure is the reverse of that described hereinbefore, as regards the electrical connections and as regards the procedure described for removal of the cover member 24 after the cover 23 is opened.

It will be apparent therefore that the display module 22 and the electronic unit 77 can be easily fitted by the operator without the use of instruments and tools. That is done in a very short time and it provides an electronic typewriter 12 with improved levels of performance in comparison with those of the basic machine.

It will be appreciated that the electronic typewriter, the display module, the electronic unit, the fixing means, the counteracting and connecting members and the sequence of assembly thereof as described above may be the subject of various modifications and improvements both in regard to the form and the arrangement of the various parts without departing from the scope of the present invention.

What we claim is:

1. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module;

in which the fixing means comprise resiliently-deformable counteracting members and counteracting surfaces which are coupled to said counteracting members for latching fixing of the display module to said casing; and in which the fixing means operate in a first direction and in a second direction which is perpendicular to the first direction and comprise a series of openings on an element of the pair comprising the display module and the casing and a series of hooks on the other element of said pair;

wherein said hooks are capable of being accommodated in said openings along said first direction against the action of said counteracting members and to be displaced in the second direction to engage with edges of the openings after being accommodated in said openings to prevent movement of the display module with respect to said casing in the first direction; and wherein said counteracting members are capable of latching engagement with said counteracting surfaces after engagement of the hooks with said edges to prevent movement of the display module with respect to said casing in the second direction.

2. An electronic typewriter according to claim 1, in which said casing comprises a flat surface having said series of openings and at least one seat with a resiliently deformable edge, wherein each deformable counteracting member comprises a resilient tongue provided by the flat surface and having a counteracting end, the display module comprises a bottom from which said hooks project downwardly and a pin portion which can be accommodated in said seat, wherein each counteracting surface is provided in said bottom and wherein said resilient tongue urges the counteracting end against said counteracting surface after latching engagement in such a way as to hold said pin portion against the deformable edge of said seat for fixing the bottom of the display module on said casing without play.

3. An electronic typewriter according to claim 2, in which said flat surface comprises an opening and a groove, said connecting means comprise a connector of the display module and a flexible cable, wherein said opening is capable of permitting the connector of said display module to pass therethrough and wherein said groove is connected to said opening to guide said flexible cable between the display module and said connector.

4. An electronic typewriter according to claim 2, in which said display module comprises a case in which a flat display is accommodated for displaying one or more lines of characters and/or symbols, and said module comprises a base on which said case is pivoted for modifying the inclination of said display with respect to said casing.

5. An electronic typewriter according to claim 4, in which said case is of substantially parallelepipedic shape and wherein said base comprises two side portions for mounting the case and a transverse plate which defines said bottom.

6. An electronic typewriter according to claim 1, wherein said casing comprises a cover movable from a first position in which it is normally supported on the casing to a second position in which it permits access to the typing members, said fixing means being provided for fixing the display module to said cover.

7. An electronic typewriter according to claim 6, in which said resiliently deformable counteracting members are provided on said movable cover, and comprise a projection for disengagement from said counteracting surfaces, being accessible manually in the second position of the cover for removal of the display module from said cover.

8. An electronic typewriter according to claim 6, further comprising a cover member capable of being removably fixed on said cover as an alternative to the display module.

9. An electronic typewriter according to claim 1, wherein said display module comprises a case in which a flat display is accommodated for displaying one or more lines of characters and/or symbols.

10. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module, wherein said casing comprises a cover movable from a first position to a second position in which it permits access to the typing members, said fixing means being provided for fixing the display module to said cover, wherein said fixing means comprise resilient deformable members which are accessible in the second position of the cover for the removal of the display module in said second position of the cover.

wherein said cover comprises a flat surface having an opening and guide means, said connecting means comprise a connector and a flexible cable, wherein said opening is capable of permitting the connector of said display module to pass therethrough and wherein said guide means guide said flexible cable between the display module and said connector, and wherein said display module comprises a case in which a flat display is accommodated for displaying one or more lines of characters and/or symbols and a base on which said case is pivoted for modifying the inclination of the display module with respect to said casing.

11. An electronic typewriter according to claim 10, including a protection element mounted on fixed guides of said casing and delimits a seat capable of accommodating said flexible cable in such a way as to prevent contact from occurring between the typing members and the flexible cable during movement of said typing members.

12. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module, wherein said casing comprises a cover movable from a first position to a second position in which it permits access to the typing members, said fixing means being provided for fixing the display module to said cover, wherein said fixing means comprise resilient deformable members which are accessible in the second position of the cover for the removal of the display module in said second position of the cover, in which a support base supports said electronic control means, wherein a plate member supports said electronic unit and comprises a limb capable of engaging a shaped seat in the support base and carrying a connector capable of connecting to a complementary connector of the electronic control means, in which said plate member supports a complementary connector of said electronic unit which is capable of being connected to the connector of the display module.

13. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module, wherein said casing comprises a cover movable from a first position to a second position in which it permits access to the typing members, said fixing means being provided for fixing the display module to said cover, wherein said fixing means comprise resilient deformable members which are accessible in the second position of the cover for the removal of the display module in said second position of the cover, in which said display module comprises a case having a substantially parallelepipedic shape and wherein a base comprises two side portions for mounting the case and a transverse plate which defines a bottom through which the display module is fixed on said casing.

14. An electronic typewriter according to claim 13, further comprising friction means between the case and the base for frictionally retarding the movement of said case with respect to said base.

15. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module, wherein said casing comprises a cover movable from a first position to a second position in which it permits access to the typing members, said fixing means being provided for fixing the display module to said cover, wherein said fixing means comprise resilient deformable members which are accessible in the second position of the cover for the removal of the display module in said second position of the cover, in which a support base supports the electronic control means and a plate member supports the electronic unit, wherein said casing has a bottom and comprises an access opening provided in said bottom for access of the plate member to the support base and wherein said access opening is closed by a cover portion which is removably fixed to said bottom.

16. An electronic typewriter comprising:

typing members and electromechanical devices for actuating typing and machine functions;

electronic control means for control of said typing members and said electromechanical devices;

a casing enclosing said typing members and said electromechanical devices, said casing comprising a cover tiltable between first and second positions, said cover having an aperture therein and a cover member on said cover and covering said aperture;

a display module for displaying text and machine functions;

an electronic unit for controlling said display module; and further means for enabling the typewriter to be functionally improved with the display module and the electronic unit for controlling said display module, said further means comprising:

first fixing means between said cover member and said cover for removably fixing said cover member to said cover, said first fixing means comprising deformable releasable latching means on said cover for fixing said display module to said cover as an alternative to said cover member;

an aperture in said casing, wherein second fixing means is within said casing and accessible through said aperture in said casing for receiving and fixing said electronic unit; and a second removable cover member for said aperture in the casing;

said electronic control means including electrical connector means for connection to said electronic unit to be fixed in said casing by said second fixing means;

whereby said cover member is removed and replaced by said display module which is tiltable by tilting of said cover, and said electronic unit is fixable by said second fixing means and electrical means for connection to said display module and said electronic control means, and wherein said electronic unit for controlling said display module is insertable through said aperture in the casing.

17. An electronic typewriter according to claim 16, in which said second fixing means comprises deformable latching means, said first and second fixing means providing for removal of said cover member and fitting of said display module and said electronic unit without the need for tools.

18. An electronic typewriter comprising:

typing members and electromechanical devices for actuating typing and machine functions;

electronic control means for associated control thereof;

a casing which encloses said members and said devices;

a display module for displaying text and/or machine functions;

fixing means for removably fixing said display module to said casing;

an electronic unit for controlling said display module; and connecting means for removably connecting said electronic unit to said display module, wherein said display module comprises a case in which a flat display is accommodated for displaying one or more lines of characters and/or symbols, further comprising a supply circuit for providing low voltage current for the typing members and/or the machine functions and in which said display is of the liquid crystal type which can be observed in a transparency mode, and said case also accommodates a neon lamp for lighting said display, and a voltage booster circuit connected to said supply circuit and operable to convert the low voltage current into a high voltage current for said neon lamp.

19. An electronic typewriter according to claim 18, having a keyboard and wherein the electronic control means comprises a microprocessor connected to the keyboard, ROM and RAM memories and actuator circuits for controlling said typing members and said electromechanical devices for actuating typing and machine functions, and in which said electronic unit comprises a second microprocessor connected to second ROM and RAM memories for controlling display functions of the display module.

* * * * *